United States Patent [19]

Schmoll et al.

[11] Patent Number: 4,831,864

[45] Date of Patent: May 23, 1989

[54] FORGING MACHINE

[75] Inventors: Heinz Schmoll, Kaarst; Hans A. Schubert, Düsseldorf; Klaus Schulze, Moenchengladbach, all of Fed. Rep. of Germany

[73] Assignee: SMS Hasenclever Machinenfabrik GmbH, Dusseldorf, Fed. Rep. of Germany

[21] Appl. No.: 947,309

[22] Filed: Dec. 29, 1986

[30] Foreign Application Priority Data

Jan. 2, 1986 [DE] Fed. Rep. of Germany ..... 3600018
Sep. 4, 1986 [DE] Fed. Rep. of Germany ..... 3630172

[51] Int. Cl.[4] ..... B21J 7/14; B21J 7/28

[52] U.S. Cl. ..... 72/402; 72/446; 72/453.01; 100/269 R

[58] Field of Search ..... 72/402, 407, 446, 453.01, 72/453.02, 399; 100/269 R, 264

[56] References Cited

U.S. PATENT DOCUMENTS

| | | | |
|---|---|---|---|
| 3,348,406 | 10/1967 | Holberson | 72/446 |
| 3,373,596 | 3/1968 | Moeller et al. | 72/446 |
| 3,613,432 | 10/1971 | Schenk et al. | 72/402 |
| 3,626,746 | 12/1971 | Pietryka | 72/407 |
| 3,656,334 | 4/1972 | Schenk et al. | 72/399 |
| 3,657,916 | 4/1972 | Pahnke | 72/399 |
| 3,822,456 | 7/1974 | Petruzzi | 72/402 |
| 3,841,125 | 10/1974 | Guse | 72/402 |
| 3,841,143 | 10/1974 | Harada | 72/453.01 |
| 3,916,667 | 11/1975 | Pahnke et al. | 72/402 |
| 3,919,877 | 11/1975 | Netta | 72/453.01 |
| 3,929,000 | 12/1975 | Kralowetz | 72/402 |
| 4,578,983 | 4/1986 | Kimura | 72/402 |

FOREIGN PATENT DOCUMENTS

| | | | |
|---|---|---|---|
| 449558 | 9/1927 | Fed. Rep. of Germany | 72/402 |
| 1963979 | 12/1969 | Fed. Rep. of Germany . | |
| 2030471 | 1/1970 | Fed. Rep. of Germany . | |
| 2055592 | 11/1970 | Fed. Rep. of Germany . | |
| 612744 | 6/1978 | U.S.S.R. | 72/402 |
| 565445 | 5/1979 | U.S.S.R. | 72/402 |
| 517015 | 2/1939 | United Kingdom . | |
| 810337 | 3/1959 | United Kingdom | 72/402 |
| 1186379 | 7/1967 | United Kingdom . | |
| 1302095 | 1/1973 | United Kingdom | 72/402 |

OTHER PUBLICATIONS

Pahnke Engineering Leaflet, "Radial Forging Mill", Pahnke Engineering GmbH & Co., Duesseldorf, Germany.

*Primary Examiner*—Daniel C. Crane
*Attorney, Agent, or Firm*—Holman & Stern

[57] ABSTRACT

In a forging machine, each ram is the piston or cylinder of a piston-cylinder hydraulic unit and the other component of the unit is attached to the forging machine frame and can be moved to adjust the ram stroke position. The piston or cylinder which constitutes the ram is guided directly in the machine frame to minimize play in the guidance of the ram component.

19 Claims, 6 Drawing Sheets

FORGING MACHINE

BACKGROUND OF THE INVENTION

1. Field of the Invention

This invention relates to apparatus for the forging of metals, in particular to apparatus known as forging machines.

2. Description of the Prior Art

Forging machines, that is to say rapid stroke forging presses with two rams or at the most four rams which in this case lie in an x-shaped arrangement in one plane, are offset by 90° relative to one another and act radially on the workpiece, are designed with mechanical or hydraulic ram drives and are used for reshaping workpieces extended on their longitudinal axes. Mechanical ram drives permit very high working speeds and stroke rates of the rams, but the depth of penetration is small. If greater depths of penetration are required, hydraulic ram drive is advantageous. In the ram motion, a distinction is to be made between the working stroke proper, and the part of the stroke in which the measure of the ram approach, i.e., the workpiece dimensions, is preset. This measure, or the position in which the working stroke is effected, is designated the stroke position, which is adjusted by stroke position adjustment. Stroke position adjustment by changing the amount of liquid in the cylinders which are provided for the full range of the stroke is precluded, in the case of rapid stroke forging presses, because of the high level of cushioning action due to the presence, in most stroke positions, of an unnecessarily large volume of pressurized fluid. For a long time, therefore, the drive for the stroke position adjustment has been separated from the hydraulic drive for the working stroke. In this case, the pistons which move the rams have been disposed in short-stroke cylinders of small volume specified by the piston stroke and the piston surface, and the piston stroke is mechanically limited by stops, while the stroke position adjustment is generally carried out mechanically separately by spindles. Thus it is known (German published specification OS 21 43668) to provide an annular piston for the working stroke, which is non-rotatably guided in a cylinder and is provided with a threaded bore, in which a threaded spindle is rotatably inserted, which acts on the ram. The guidance play can be kept to a minimum by direct guiding of the ram in the machine frame, however it is disadvantageous for several, e.g. four, annular pistons to be symmetrically connected to each ram with an inserted threaded spindle, as this requires considerable structural expenditure. A less expensive solution (Peter Metzger, "Die numerisch gesteuerte Radial-Umformmaschine und ihr Einsatz im Rahmen einer flexiblen Fertigung" - "The numerically controlled radial forming machine and its use in the context of flexible manufacture" - Volume 55 of the reports from the Institut Fur Formtechnik of the University of Stuttgart, ed Prof Dr-Ing K Lange, Springer-Verlag, Berlin-Heidelberg-New York, 1980, pages 38, 112, 113) is to move the cylinders with the pistons and rams, for the purpose of stroke position adjustment, via spindles, mounted on the cylinders, by means of worm wheels, worms and servomotors, which requires particular guiding means for the adjustable cylinders. The guiding of the ram in the cylinder and the cylinder in the machine frame inevitably leads to higher guide play of the ram with respect to the machine frame

BRIEF SUMMARY OF THE INVENTION

An object of the invention is to provide an improved forging machine of the type which has a hydraulic drive for the working stroke and a mechanically separate drive for the stroke position adjustment. A particular object of the invention is to ensure solid ram guidance with minimal play, and simple mechanical stroke position adjustment, with a minimal volume of oil which is effective for the working stroke in the hydraulic drive and effects the dynamic behavior of the forging machine.

According to the present invention, the normally static piston or cylinder of a piston-cylinder unit, of which the cylinder or piston respectively constitutes the movable forging ram, defines the ram stroke and is adjustable in position, and the component constituting the ram is slidably guided directly in the forging machine frame, thereby minimizing play in the guidance of the ram.

More specifically, in forging machines of the type described, in which the rams, provided with tools and performing the working stroke, are designed in each case as one part (stroke part) of piston-cylinder units, the second parts (adjusting parts) of which limit the stroke capacity in the direction of reaction pressure and are axially adjustable over the regulating distance (stroke position adjustment) remaining from the full stroke after subtraction of the working stroke, according to the invention the rams, each constituting one part of the piston cylinder unit, are guided directly in the machine frame (immovable part).

More particularly this invention resides in a forging machine comprising a frame: a plurality of pressure-fluid piston and cylinder units disposed in a working plane of the machine, each unit comprising a cylinder component and a piston component therein, said components being slidable relative to one another in an axial direction of the unit, the units having the axes thereof disposed in said plane at angles to one another in respective radial directions relative to a workpiece axis position for forging a workpiece; each unit having one component thereof slidably guided directly in the machine frame for sliding in the respective radial direction and constituting a respective forging ram of the machine, the other component of the unit being disposed, in operation, fixedly relative to the machine frame and comprising means for limiting the stroke of the ram; and means for adjusting the axial position of the other component in the radial direction, for setting the ram stroke position.

If the rams are the pistons of the piston-cylinder units, preferably the cylinders are rigidly fitted into the machine frame, and the cylinders are provided with adjustable plugs which form the bases of the cylinders and act as the means for ram stroke adjustment.

It is particularly advantageous, according to a further feature of the invention, to provide the plug with a central bore and to provide the piston with a shaft which passes through the hollow plug bore, the shaft being provided with the stroke limiters and/or return-stroke devices for the pistons.

Since in this embodiment the pistons must be guided in the cylinders and sealed, according to another feature of the invention the pistons are connected to protective casings which enclose the cylinders with minimal clearance especially to protect the sliding surfaces, and compressed air is forced into the casings, passing through the gap between the cylinders and the protective casings to form a dirt seal. The encasing of the cylinders must be carried out over a length of, at the most, a little more than the total stroke measurement, and the remaining length of the cylinder is available in its connection with the machine frame.

If the rams are cylinders of the piston-cylinder units, the pistons are arranged as adjusting components so that they are axially adjustable with respect to the machine frame.

Double acting pistons can be provided which are connected to adjustment means via their piston rods, and the pistons can be designed for stroke limiting as well as stroke return. On the other hand, however, the pistons can be annular pistons, and the cylinders which act as rams have internal shafts which penetrate the annular pistons to define annular cylinders. these shafts can be designed with the means for stroke limiting and/or stroke return of the cylinders. If the pistons and provided with the plugs, or the cylinders are provided with shafts which penetrate the pistons, these can be provided with collars, crossheads or the like which serve as stroke limiting stops and/or pull-back pistons as supports. The shafts can themselves be bored and receive the means for securing and/or adjusting the tools which are connected to the rams, otherwise these means must be guided laterally past the piston-cylinder units. Further, the shafts can be guided in the bores which receive them and thus the pistons or cylinders can be guided non-rotatably with respect to the plugs or pistons, in which case rectangular sections can be provided in the shafts and bores. Otherwise the rams designed as pistons or cylinders are to be provided, in at least one section of their guidings in the machine frame, with non-circular, in particular plane, guiding members which eliminate rotation of the pistons or cylinders in the machine frame.

For adjusting the stroke position, according to a further feature of the invention, adjusting parts, i.e. the plugs or pistons, are connected to yoke plates, which the means of adjustment engage. In particular, according to a further feature of the invention, threaded nuts are mounted in the yoke plates and are adjustable along two or more threaded spindles which are connected to the machine frame. It is advantageous to provide the threaded nuts with exterior toothings and drivingly to connect them by means of a gear ring in order to be able to rotate or secure them all simultaneously.

BRIEF DESCRIPTION OF THE DRAWINGS

The invention will now be described in detail with reference to the accompanying drawings which show three embodiments of the invention wherein.

DETAILED DESCRIPTION

Figure 1:
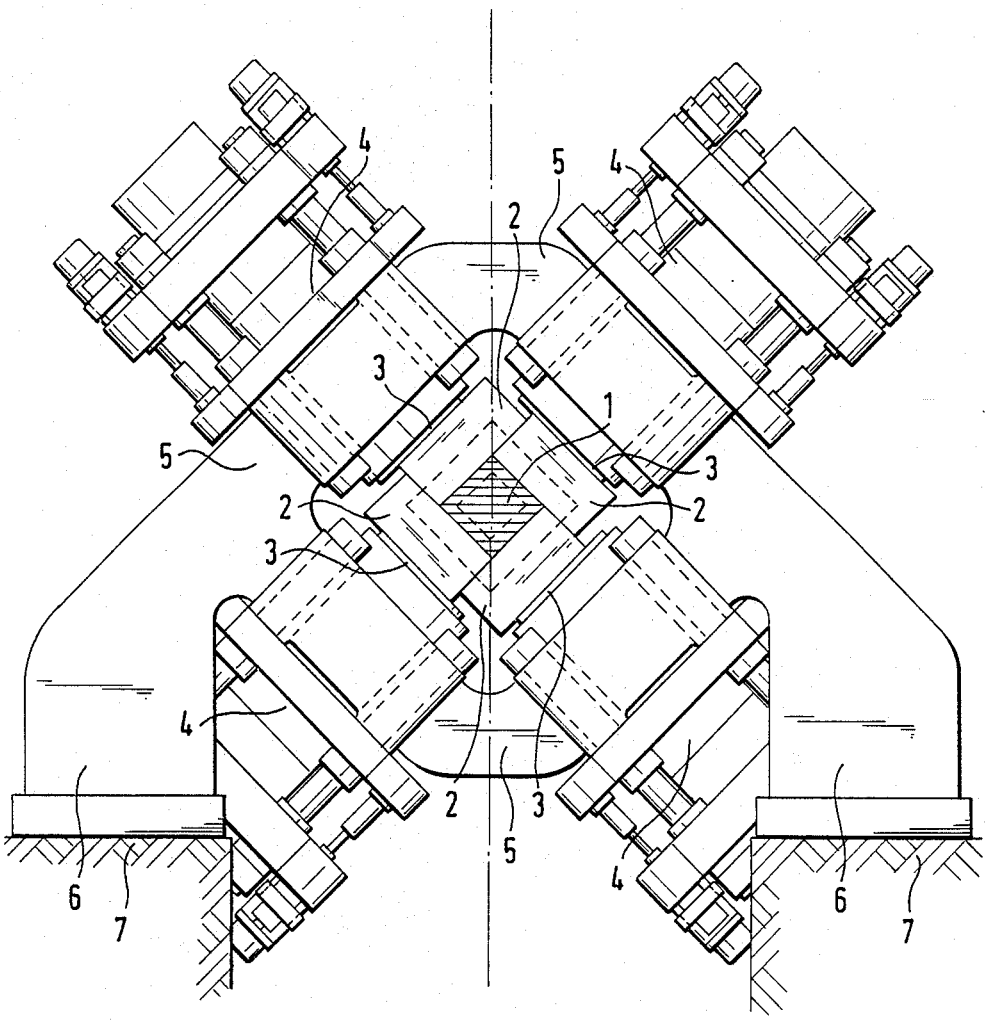
FIG. 1 is an end elevational view of a forging machine of the invention in the longitudinal axial direction of the workpiece

FIG. 1 shows a forging machine comprising a machine frame 5 with four sides at right angles enclosing a window or aperture for an elongate metal workpiece 1 to be forged, shown in cross section. Around the window or aperture are four piston-cylinder units each comprising a cylinder 4 in which is slidable a piston 3 which also constitutes a forging ram carrying a tool 2, so arranged that the tools act simultaneously on the workpiece, which is passed length-wise through the machine and is extended therein by the operation of the forging tools 2.

The tools 2 are arranged in crossed closed manner, i.e. positioned off center so as to correspond to the section to be forged and arranged around the workpiece 1 with their working surfaces overlapping respective adjacent tools 2. The respective off center positioning of the tools 2 determines the possible approach of the tools 2 and thus the smallest section which can be forged with a specific tool position, which in turn determines the inner reversal point of the stroke position.

The tools 2 are carried by rams 3, which are designed as pistons and are slidably guided in cylinders 4. Four cylinders 4 are disposed in the machine frame 5, in a manner corresponding to the X-shaped arrangement of the rams or pistons 3 in one plane in which they are offset from one another 90° and are movable in a radial direction with respect to the longitudinal axis of the workpiece. The machine frame 5 is anchored to the floor 7 by means of feet 6.

Figure 2:
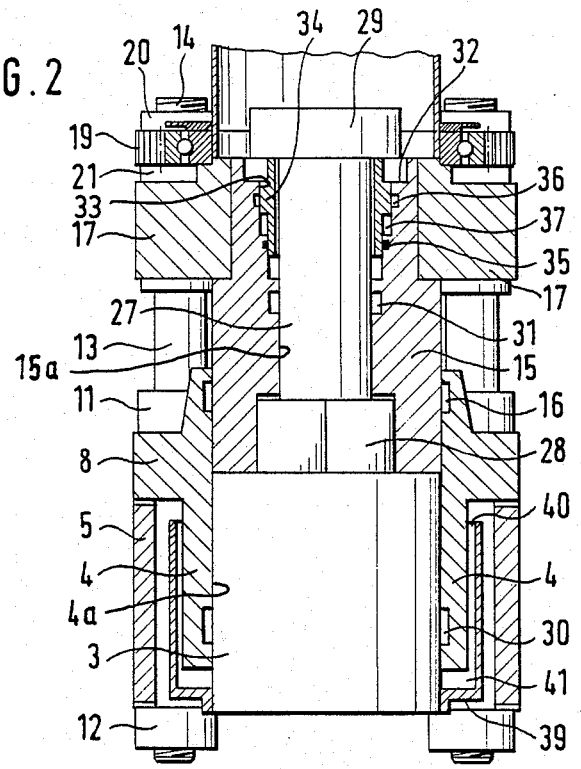
FIG. 2 is a cross sectional view of a piston-cylinder unit of the forging machine taken along the line II—II shown in FIG. 3.
Figure 3:
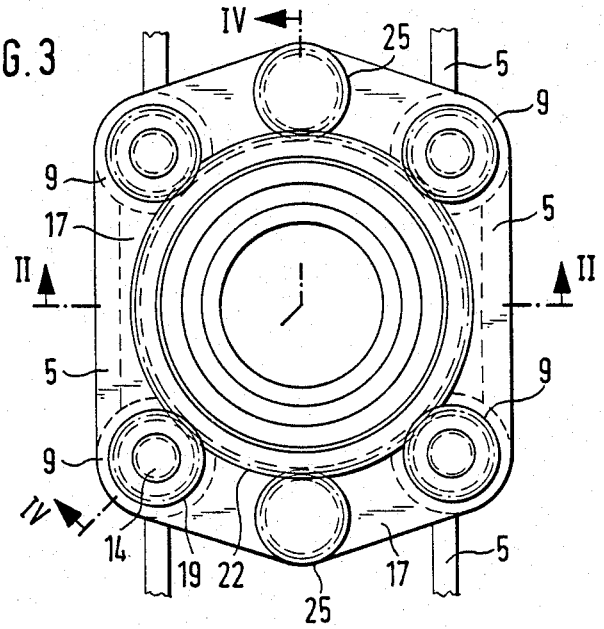
FIG. 3 is a top plan view of the piston-cylinder unit of FIG. 2.
Figure 4:
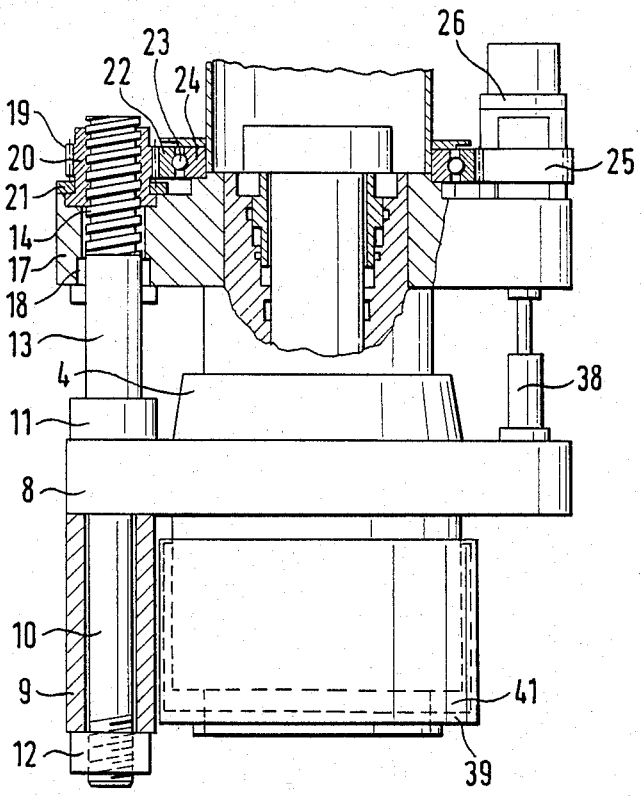
FIG. 4 is a cross-sectional view of the same piston-cylinder unit taken along the line IV—IV of FIG. 3

The units formed by the rams or pistons 3 and the cylinders 4 are represented in detail in FIGS. 2 to 4.

The cylinders 4 are provided with flanges 8 and the machine frames 5 with four eyes for each cylinder 4 for the purpose of securing the cylinders to the machine frame. Tension rods 10 pass through the bores in the flanges 8 of the cylinders 4 and the eyes of the machine frame and have collars 11 which lie against the flanges 8, and on the rods 10 nuts 12 brace the flanges 8 and hence the cylinders 4 against the machine frame 5. The tension rods 10 are furthermore extended upwards into spindles 13 with screw-threaded shafts 14.

Each cylinder 4 has a bore **4*a* passing through it which is closed at one end by a plug 15 which has a seal 16. The plug is firmly secured to a yoke plate 17 which is provided with four bores 18 for the spindles 13 to pass through to the tension rods 10. The bores 18 are widened into bearing bores, in which nuts 20 each provided with gear toothing 19 on the outside and a thread on the inside are rotatably disposed and held by split bearing plates 21. The four nuts 20 of one yoke plate 17 are rotated together by a gear ring 22 which is rotatable with balls 23 on a bearing ring 24 centered and secured on the yoke plate 17. Drive pinions 25, which mesh with the gear ring 22, can be rotated or locked as required via a transmission 26. As the pinions 25 rotate, the nuts 20 with the toothing 19 are rotated via the gear ring 22, and move along the threaded shafts 14 on the spindles 13, thereby axially adjusting the plug 15 in the bore of the cylinder 4**.

A piston 3, which carries the tool (not shown in FIGS. 2 to 4) and which is designed as a ram, is guided in each cylinder 4 for axial sliding. The piston 3 is provided with a circular shaft 27 and, in the transition from the piston 3 to the shaft 27, with a rectangular section 28. Further, the shaft 27 is provided with a head 29. The plug 15 is provided with a corresponding circular bore 15*a* with a rectangular portion in the region of the section 28, the rectangular section 28 non-rotatably guiding the piston in the corresponding rectangular bore of the plug 15. The space for the pressure medium in the cylinder 4 between the piston 3 and the plug 15 is sealed by the seals 30 and 31. The axial movement of the piston 3 is limited on the one hand by its being stopped against the plug 15 and on the other hand by the head 29 on the piston shaft 27 as the head 29 comes into contact with the rear face 32 of the plug 15. If required, the head 29 on the piston shaft 27 can be axially adjustable, so that the stroke of the piston 3 as limited by the stops is also adjustable. The stroke position of the piston 3 can be adjusted by adjustment of the yoke plate 17 as described above by rotation of the nuts 20 on the threaded shafts 14 of the spindles 13. For the retraction or reverse stroke of the piston 3, the plug 15 is bored out from the rear side to form a cylinder chamber 33. An annular piston 34 is inserted into this cylinder chamber 33, sits on the shaft 27 of the piston 3, and abuts on the head 29, and encloses an annular space 37 between seals 35 and 36, so that pressurization of the annular space 37 causes the reverse stroke of the piston 3 to be effected to lift the piston.

Piston-cylinder units 38 are disposed between the flange 8 of the cylinder 4 and the yoke plate 17 and maintain the position of the threaded nuts 20 on the threaded shaft 14 constant in the direction of working pressure in order to guarantee that the plug 15 is supported free from play.

In order to eliminate any contamination of the piston 3 where it is outside the cylinder 4 by scale, water spray or the like, a protective casing 39 is placed over the piston 3 and surrounds the cylinder 4 on the outside with minimal clearance. Compressed air is blown into the protective casing 39 and is discharged through the annular gap 40 between the protective casing 39 and the cylinder 4, and thus prevents the penetration of dirt into the space 41 covered by the protective casing 39.

Figure 5:
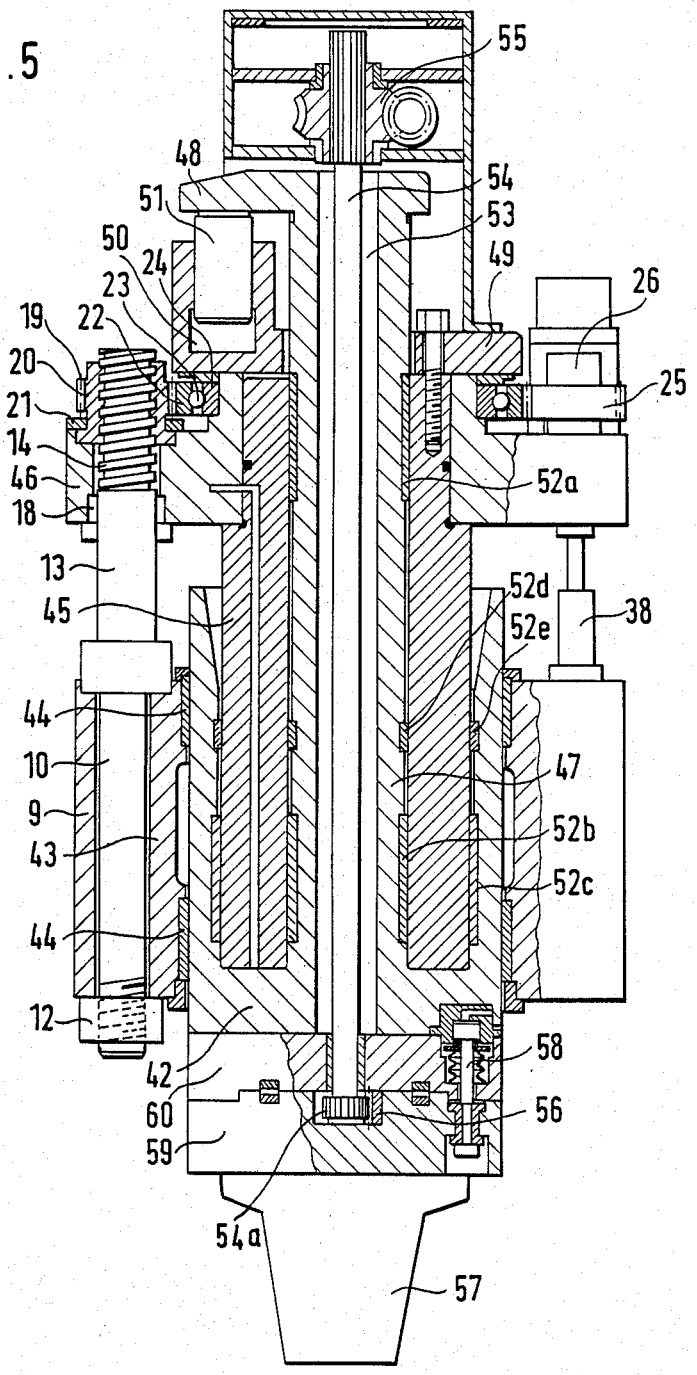
FIG. 5 is a cross sectional view corresponding generally to FIG. 4 of a second embodiment of a piston-cylinder unit.

FIG. 5 illustrates a second embodiment in which the rams are designed as cylinders, one of which is shown in FIG. 5. The cylinders 42 are guided in the machine frame 43, in the case of cylinders 42 which are circular on the outside, in guide bushings 44, and in the case of flattened cylinders which are not circular on the outside, the guide bushes 44 are replaced by guide disks of the corresponding shape. Each cylinder 42 forms a unit with a piston 45 which is supported on a yoke plate 46. Adjustment of the yoke plate 46 with repect to the machine frame 43 is provided for in the same way as the yoke plate 17 with respect to the machine frame 5 in FIGS. 2 to 4, and the parts which correspond to one another in the two embodiments have the same reference numbers. For a description of the adjustment the reader is referred to the description of the first embodiment.

The piston 45 is of annular cross section and the cylinder 42 is correspondingly provided with a central shaft 47 which extends through the annular piston 45. The shaft 47 is provided with a crosshead 48 at its upper end. A plate 49 is placed over the yoke plate 46 and piston 45, and is provided with cylinder bores 50. Pistons 51 in the cylinder bores 50 can be operated to retract the cylinder 42, and the working stroke of the cylinder 42 is limited on the one hand by the lower end of the annular piston 45 and on the other hand by the pistons 51 abutting the lower ends of cylinder 50. Between the annular piston 45 and the cylinder 42 and shaft 47, bushings 52*a, b,* and *c* are provided for guidance, and sealing rings 52 *d* and *e* are provided for sealing. The shaft 47 and the design of the piston 45 as an annular piston provide the option of tool adjustment by way of a bore 53 in the shaft 47. A spindle 54 is provided in the bore 53 and can be rotated and locked via a worm drive 55. A pinion 54*a* connected to the bottom of the spindle 54 meshes with a toothed rack 56 in the sliding saddle 59 which carries the tool 57 and is secured to a head piece 60 by clamping devices 58, the head piece 60 being connected to the cylinder 42. When the clamping devices 58 are released the tool 57 can be adjusted in the working plane, transverse to the ram axis, by sliding of its saddle 59 on the head piece 60 effected by rotation of spindle 54 and pinion 54*a*. A tool adjustment can be effected in the same way in the case of the first embodiment, if the piston shaft 27 has an axial bore.

Figure 6:
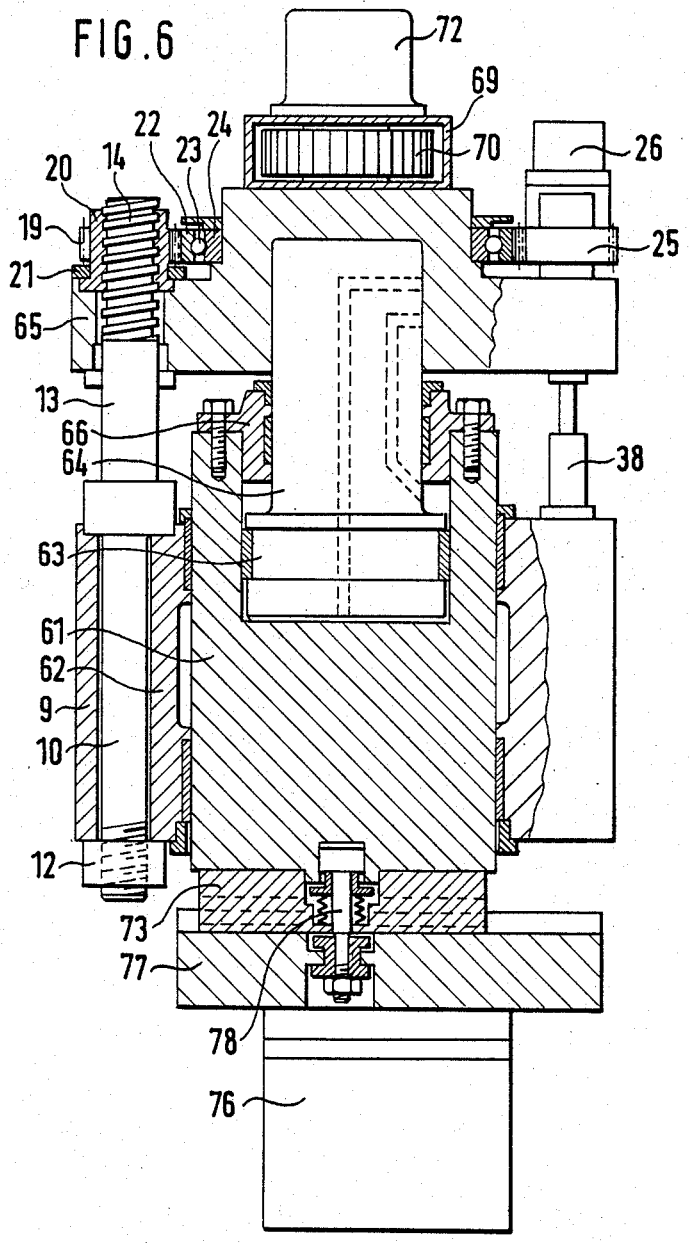
FIG. 6 is a cross sectional view generally corresponding to FIG. 4 showing a third embodiment of a piston-cylinder unit.
Figure 7:
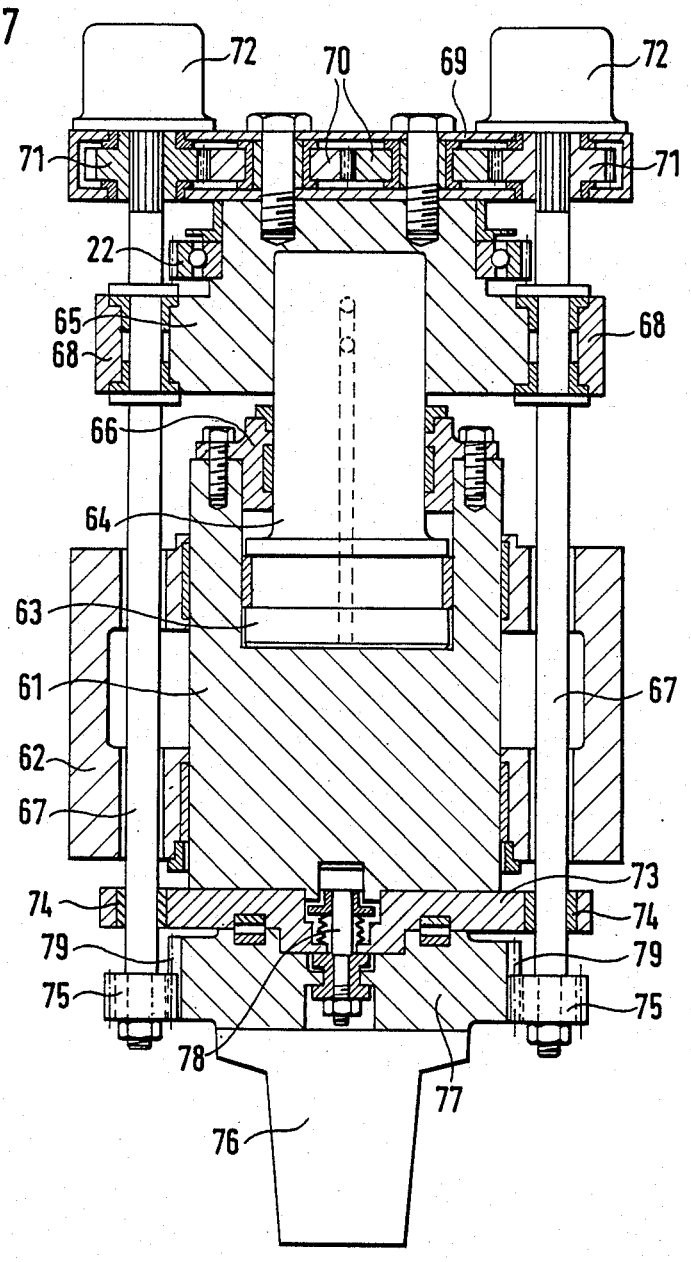
FIG. 7 is a cross sectional view corresponding generally to FIG. 2, showing the third embodiment of a piston-cylinder unit.

The rams are also designed as cylinders 61 in the third embodiment, as shown in FIGS. 6 and 7. Each cylinder 61 is guided in the machine frame 62. Unlike the second embodiment, the pistons are double-acting pistons 63, connected to the yoke plates 65 via piston rods 64. The rear end of each cylinder 61 is closed off about the piston rod 64 by a lid 66 which also serves to limit the stroke of the cylinder 61 to the working stroke. Adjustment of the stroke position is effected via the yoke plate 65 in the same way as in the first and second embodiments. The parts which correspond to one another in the several embodiments are provided with the same reference numbers and, for a description of the adjustment means, the description in the first and second embodiments is referred to. In the case of the embodiment according to FIGS. 6 and 7 a tool adjustment by means of a centrally disposed spindle would be possible, as in the embodiment according to FIG. 5; in this case the piston 63 would have to be extended by a pin, into a bore piercing the bottom of the cylinder 61 and the cylinder would have to be sealed onto the pin. However in this embodiment, as shown in FIG. 7 in particular, the tool adjustment mechanism comprises two spindles 67 which lie on the outside, are mounted in bearings 68 secured to the yoke plate 65, and move with the yoke plate 65. A set of gears 69 is mounted on the yoke plate 65 and, via two intermediate gears 70 and gear rings 71, drivingly connects the spindles 67 which are driven by motors 72. The spindles 67 are mounted at their lower ends in a head piece 73 of the cylinder 61, in bushes 74. A saddle 77, which carries the tool 76, is guided on the head piece 73, and is releasably connected to the head piece 73 by means of a clamping device 78, is provided with toothing 79 on both longitudinal sides, in which the pinions 75 engage. When the clamping device 78 is released the tool 76 can be adjusted with its saddle 77 on the head piece 73 in the working plane, transverse to the ram axis.

We claim

1. A forging machine comprising:

a frame through which a workpiece is passed longitudinally along a workpiece axis;

a plurality of fluid pressure piston and cylinder units arranged in an operating plane extending substantially radially with respect to said workpiece axis, respective tools being mounted on said units so that said tools define a closed workpiece space opening;

each unit comprising a cylinder component, a respective piston component in each cylinder component;

said components being relatively slidable with respect to each other along an axis of each unit extending in said operating plane for forging a workpiece, said unit axes being angularly spaced relative to each other;

one of said components of each unit being slidably guided in said frame for sliding radially with respect to said workpiece axis and comprising a respective forging ram;

the other of said components of each unit being nonmovable relative to said frame during forging;

means for limiting the stroke of said ram; and means for adjusting the axial position of said other component in said radial direction for setting the ram stroke position comprising, a yoke member connected to said other component providing for ram stroke position adjustment, and stroke position adjustment means attached to said frame and engaging said yoke member causing relative movement between said frame and yoke member.

2. A forging machine as claimed in claim 22 wherein in each said piston and cylinder unit;

said cylinder component is secured rigidly in said machine frame;

said piston component is slidable in said cylinder component and constitutes said ram;

said piston component projects from one end of said cylinder component; and a plug is provided for closing the other end of said cylinder component and is connected to said yoke member for adjustment in the axial direction of said unit for adjusting the ram stroke position.

3. A forging machine as claimed in claim 2 wherein:

said plug is provided with an axial bore;

an axial shaft is provided on said piston component extending through said bore in said plug; and said stroke-limiting means is provided on said shaft for limiting the stroke of said ram.

4. A forging machine as claimed in claim 2 wherein:

said plug is provided with an axial bore;

an axial shaft is provided on said piston component extending through said bore in said plug; and retracting means is provided on said axial shaft for retracting said pistion.

5. A forging machine as claimed in claim 2 and further comprising:

protective casing attached to said projecting piston components and arranged to cover at least part of said cylinder components with minimal clearance; and means for forcing compressed air internally of said casings for passage between said cylinder components and said casings.

6. A forging machine as claimed in claim 3 wherein:

said stroke limiting means comprises a traverse abutment on said shaft limiting the ram stroke and retracting the ram.

7. A forging machine as claimed in claim 6, and further comprising:

an annular piston associated with said abutment and guided in an annular cylinder which surrounds said shaft and bears against the plug.

8. A forging machine as claimed in claim 3 wherein said shaft is non-rotatably slidably guided.

9. A forging machine as claimed in claim 3 wherein:

said shaft has a region having a rectangular cross-section non-rotatably and slidably engaging in a correspondingly rectangular cross-section bore in said plug;

said shaft has a region having a circular cross section; and means are provided for sealing the circular region of said shaft in said bore of said plug.

10. A forging machine as claimed in claim 1 and further comprising:

at least one screw-threaded nut rotatably mounted in said yoke member;

at least one corresponding screw-threaded member fastened with said machine frame and threaded into said nut; and means for rotating said at least one nut for moving said yoke member along said at least one screw-threaded member relative to said machine frame.

11. A forging machine as claimed in claim 10 wherein: said yoke member comprises a yoke plate provided with a plurality of said nuts;

each nut is provided with external gear teeth;

each yoke plate is further provided with a ring gear rotatably mounted on said yoke plate and meshing with said gear teeth on all said nuts; and means are provided for rotating and locking said ring gear relative to said yoke plate.

12. A forging machine as claimed in claim 1, and further comprising for each yoke member:

at least one piston-cylinder unit disposed to act between said yoke member and said machine frame for tensioning the ram stroke position adjustment means and eliminating play therein.

13. A forging machine comprising:

a frame through which a workpiece is passed longitudinally along a workpiece axis;

a plurality of fluid pressure piston and cylinder units arranged in an operating plane extending substantially radially with respect to said workpiece axis, respective tools being mounted on said units so that said tools define a closed workpiece space opening;

each unit comprising, a cylinder component, a respective piston component in each cylinder component;

said components being relatively slidable with respect to each other along an axis of each unit extending in said operating plane for forging a workpiece, said unit axes being angularly spaced relative to each other;

one of said components of each unit being slidably guided in said frame for sliding radially with respect to said workpiece axis and comprising a respective forging ram;

the other of said components of each unit being nonmovable relative to said frame during forging;

means for limiting the stroke of said ram, and wherein in each said piston and cylinder unit;

said cylinder component comprises said ram and is slidably guided in said machine frame;

said piston component is mounted in said machine frame to facilitate sliding of said cylinder component on said piston component; and means is provided for adjusting the axial position of said piston component in the radial direction of said unit relative to said machine frame for setting the ram stroke position.

14. A forging machine as claimed in claim 13 wherein:

said cylinder component has an annular cross section and is provided with an internal axial shaft;

said piston component has an annular cross section encircling said axial shaft; and said means for limiting the ram stroke is provided on said axial shaft.

15. A forging machine as claimed in claim 13 wherein:

said cylinder component has an annular cross section and is provided with an internal axial shaft;

said piston component has an annular cross section encircling said axial shaft; and means is provided cooperating with said axial shaft. for retracting said cylinder component.

16. A forging machine as claimed in claim 14 wherein:

said means for limiting the ram stroke comprises a transverse abutment for limiting the ram stroke and retracting the ram.

17. A forging machine as claimed in claim 16, and further comprising:

at least two abutment pistons each having one end acting upon said transverse abutment of said shaft; and cylinders for said abutment pistons engageable with the other ends, respectively, of said abutment pistons.

18. A forging machine as claimed in claim 14 wherein said means for setting the ram position comprises:

a yoke plate connected to said piston component;

a plurality of screw-threaded nuts rotatably mounted in said yoke .plate and respective corresponding screw-threaded members each mounted on said machine frame and threaded into a respective nut; and means for rotating said nuts for thereby moving said yoke member along said screw-threaded members relative to said machine frame comprising, each nut being provided with external gear teeth, a ring gear rotatably mounted on said yoke plate and meshing with said gear teeth on all said nuts, means for rotating and locking said ring gear relative to said yoke plate, and a bearing ring for said ring gear, said bearing ring having a central bore for accommodating said shaft.

19. A forging machine comprising:

a frame through which a workpiece is passed longitudinally along a workpiece axis;

a plurality of fluid pressure piston and cylinder units arranged in an operating plane extending substantially radially with respect to said workpiece axis, respective tools being mounted on said units so that said tools define a closed workpiece space opening;

each unit comprising a cylinder component, a respective piston component in each cylinder component; each other along an axis of each unit extending in said operating plane for forging a workpiece, said unit axes being angularly spaced relative to each other, one of said components of each unit being slidably guided in said frame for sliding radially with respect to said workpiece axis and comprising a respective forging ram, the other of said components of each unit being non-movable relative to said frame during forging, means for limiting the stroke of said ram, means for adjusting the axial position of said other component in said radial direction for setting the ram stroke position, and a non-circular guiding device on at least one section of said ram for non-rotatably locating said ram in the machine frame.

* * * * *